US007763821B2

(12) United States Patent
Yoshitomo et al.

(10) Patent No.: US 7,763,821 B2
(45) Date of Patent: Jul. 27, 2010

(54) PUFFER-TYPE GAS BLAST CIRCUIT BREAKER

(75) Inventors: Yuji Yoshitomo, Tokyo (JP); Daisuke Yoshida, Tokyo (JP); Haruhiko Kohyama, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 425 days.

(21) Appl. No.: 11/746,670

(22) Filed: May 10, 2007

(65) Prior Publication Data

US 2007/0262053 A1 Nov. 15, 2007

(30) Foreign Application Priority Data

May 10, 2006 (JP) ..... 2006-131059

(51) Int. Cl.
*H01H 33/88* (2006.01)

(52) U.S. Cl. ..... 218/59; 218/57

(58) Field of Classification Search ..... 218/43–46, 218/51–68, 78–80, 153, 154
See application file for complete search history.

(56) References Cited

U.S. PATENT DOCUMENTS 5,723,840 A * 3/1998 Bojic et al. ..... 218/60

FOREIGN PATENT DOCUMENTS

JP 3-26943 3/1991

* cited by examiner

*Primary Examiner*—Renee Luebke
*Assistant Examiner*—Marina Fishman
(74) *Attorney, Agent, or Firm*—Buchanan Ingersoll & Rooney PC

(57) ABSTRACT

A puffer-type gas blast circuit breaker is capable of restraining reduction in creepage insulation resistance of an insulating support and an insulating rod due to insulating gas of high temperature. An electrode section is mounted on a stationary member supported on an insulating support, and a stationary side arc contact and moving side arc contact are disposed facing each other to contact and separate; a hollow piston rod and an insulating rod are connected to the moving side arc contact, and inserted in a stationary member body portion; and a gas flow blocking member is mounted on an end of the piston rod to prevent an insulating gas heated and coming to the stationary side from getting into the insulating rod side. The stationary member body portion is formed cylindrical so that a gap between the body portion of the stationary member and the gas flow blocking member is minimized.

2 Claims, 9 Drawing Sheets

PUFFER-TYPE GAS BLAST CIRCUIT BREAKER

BACKGROUND OF THE INVENTION

1. Field of the Invention

The present invention relates to a puffer-type gas blast circuit breaker for use in electric power system in which a breaker section is incorporated in closed container filled with an insulating gas.

2. Description of the Related Art

The Japanese Utility Model Registration Application No. 01-087840 (Japanese Utility Model Publication No. 03-026943) discloses a puffer-type gas blast circuit breaker capable of preventing an insulating gas heated by arc at the time of breaking from getting into an insulating support through a hollow part of a piston rod.

This puffer-type gas blast circuit breaker disclosed in the Japanese Utility Model Registration Application No. 01-087840 (Japanese Utility Model Publication No. 03-026943) comprises a stationary electrode section 10 and a moving electrode section 20 as shown in FIG. 4A. The stationary electrode section 10 is provided with a stationary side arc contact 13 at the center and a stationary side main contact 12 at the outer circumference. These stationary side arc contact 13 and stationary side main contact 12 are supported by a stationary side electrode support 11. The moving electrode section 20 is provided with a moving side arc contact 21 at the center and a moving side main contact 24 at the outer circumference. The moving electrode section 20 is further provided with an insulating nozzle 23 for blasting an arc generated at the time of breaking with a pressurized gas, and a puffer cylinder 22 that generates a pressurized gas at the time of breaking. The mentioned stationary electrode section 10 and moving electrode section 20 are disposed facing each other so as to come in contact with and go separating from each other, and a breaker section surrounded by an insulating cylinder 4 is formed. This breaker section is mounted on a stationary member 26 supported on an insulating support 27.

In the moving electrode section 20, a hollow piston rod 31, an insulating rod 32, and an operating rod 33 are connected in order. These connected rods run through a body portion 26*a* of the stationary member 26, and further connected to an operating device 34. In the piston rod 31, the moving side arc contact 21 is connected to a tip of one end of the piston rod 31, and the piston rod 31 is formed to be hollow with its other end closed. Furthermore, the piston rod 31 is provided with a heated gas jet port 31*a* at the other end side for jetting out a heated gas laterally. The insulating rod 32 is capable of insulating from the operating device 34 and transferring an operating force. A gas flow blocking member 35 is mounted on the connection part between the piston rod 31 and the insulating rod 32 so that the insulating support 27 may be prevented from the insulating gas heated at the time of breaking that might get in from the inner circumference of the piston rod 31.

When this known puffer type gas blast circuit breaker constructed as mentioned above begins the contact opening operation, the stationary side main contact 12 and the moving side main contact 24 are opened and separated from each other, and then the stationary side arc contact 13 and the moving side arc contact 21 are opened and separated from each other, thereby arc being generated. Then, the arc is blasted with an insulating gas pressurized at a puffer chamber 22*a* of the puffer cylinder 22, whereby the insulating gas is heated by the arc and jetted out of the insulating nozzle 23 to the stationary side electrode support 11. At the same time, the insulating gas jets out of the hollow part of the piston rod 31 into the body portion 26*a* of the stationary member 26 through the heated gas jet port 31*a* to be cooled by being mixed with the insulating gas of normal temperature remaining in the body portion 26*a*, then is discharged from a gas discharge port 26*b* of the body portion 26*a* of the stationary member 26 into the closed container 1.

The manner of flow of the insulating gas discharged out of the piston rod 31 in the opening and separating process of the stationary electrode section 10 and moving electrode section 20 at the time of breaking in the conventional puffer-type gas blast circuit breaker of above construction is discussing more specifically with reference to FIGS. 4A and 4B.

FIG. 4A shows a closed state of the stationary electrode section 10 and moving electrode section 20, FIG. 4B shows an intermediate stage of the separating process, and FIG. 4C shows an opened state of the stationary electrode section 10 and moving electrode section 20.

In the closed state of the stationary electrode section 10 and moving electrode section 20 shown in FIG. 4A, the gas flow blocking member 35 is located at a position on the breaking section side of the body portion 26*a* of the stationary member 26. In the state shown in FIG. 4B, the gas flow blocking member 35 is located at a position of the gas discharge port 26*b* of the body portion 26*a* of the stationary member 26. In the opened state shown in FIG. 4C, the gas flow blocking member 35 is located on the insulating support side of the body portion 26*a* of the stationary member 26.

As mentioned above, in the conventional puffer-type gas blast circuit breaker, the gas flow blocking member 35 is located at the position of the gas discharge port 26*b* of the body portion 26*a* of the stationary member 26 in the separating stage as shown in FIG. 4B. Accordingly, at the time of breaking, the insulating gas jetting out of the piston rod 31 through the gas discharge port 31*a* runs around the outer circumference of the gas flow blocking member 35, coming into the inner circumference on the insulating support side (lower side in the drawing) of the body portion 26*a* of the stationary member, then gets into the inner circumference of the insulating support 27. When completing the separating operation, as shown in FIG. 4C, the gas flow blocking member 35 is located on the insulating support side of the body portion 26*a* of the stationary member 26, and the heated insulating gas is now blocked from further getting into the inner circumference of the insulating support 27.

FIG. 5 is a cross-sectional view of the stationary member of FIG. 4 locating at the position of the gas discharge port at the time of completing the separating operation. As shown in the drawing, the heated insulating gas discharged from the heated gas discharge port 31*a* of the piston rod 31 goes around circumferentially within the body portion 26*a* of the stationary member 26, and is mixed with the insulating gas of normal temperature in the body portion 26*a*. As a result, the insulating gas of lowered temperature is discharged from the gas discharge port 26*b* into the closed container 1, whereby insulation resistance of the insulating support 27 and the closed container 1 can be kept.

In the puffer-type gas blast circuit breaker of above construction disclosed in the Japanese Utility Model Registration Application No. 01-087840 (Japanese Utility Model Publication No. 03-026943), it is to be noted that, during the breaking operation shown in FIG. 4B, the insulating gas getting into the stationary member 26 from the inner circumference of the piston rod 31 goes around the outer circumference of the gas flow blocking member 35, and gets into the inner circumference of the insulating support 27. It is certain that the time, during which the gas flow blocking member 35 is located at the position of the gas discharge port 26*b* of the body portion 26*a* of the stationary member 26, is short, but amount of the gas heated at the time of breaking is considerably large. As a result, a problem incidental to the conventional puffer-type gas blast circuit breaker exists in that a large amount of heated gas gets into the insulating support 27, thereby reducing density of the gas of normal temperature in the insulating support 27. Consequently, insulation resistance of the inner surface of the insulating support 27 and the creepage surface of the insulating rod 32 located inside of the insulating support is lowered eventually resulting in improved insulating reliability.

SUMMARY OF THE INVENTION

The present invention was made to solve the above-discussed problems, and has an object of providing a puffer-type gas blast circuit breaker capable of preventing an insulating gas of high temperature from getting into the internal part of an insulating support from a piston rod at the time of breaking, and in which insulation resistance of the inner surface of the insulating support and the creepage surface of the insulating rod located inside of the insulating support is restrained from lowering.

A puffer-type gas blast circuit breaker according to the invention comprises: an electrode section in which stationary side arc contact and moving side arc contact are disposed facing each other so as to come in contact with and go separating from each other, the electrode section being mounted on a stationary member supported in an insulating manner on an insulating support; a hollow piston rod and an insulating rod that are connected to the moving side arc contact so as to come in contact with and go separating from the stationary side arc contact, the connected hollow piston rod and insulating rod being inserted in a body portion of the stationary member; and a gas flow blocking member mounted on an end portion of the piston rod side of the insulating rod, the gas flow blocking member preventing an insulating gas heated by the ark generated at the time of breaking and coming to the stationary side from the hollow part of the piston rod from getting into the insulating rod side. In this puffer-type gas blast circuit breaker, the body portion of the stationary member is formed to be cylindrical so that a gap between the body portion of the stationary member and the gas flow blocking member is minimized within the operation range of the gas flow blocking member.

In the puffer-type gas blast circuit breaker according to the invention of above construction, since the gas flow blocking member is mounted on an end portion of the piston rod side of the insulating rod, thereby preventing an insulating gas heated by the ark generated at the time of breaking and coming to the stationary side from the hollow part of the piston rod from getting into the insulating rod side, and furthermore the body portion of the stationary member is formed to be cylindrical so that a gap between the body portion of the stationary member and the gas flow blocking member is minimized within the operation range of the gas flow blocking member, it becomes possible to prevent an insulating gas of high temperature from getting into the internal part of an insulating support from a piston rod at the time of breaking, and insulation resistance of the inner surface of the insulating support and the creepage surface of the insulating rod located inside of the insulating support is restrained from lowering, resulting in higher insulation reliability.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Embodiment 1

Figure 1A:
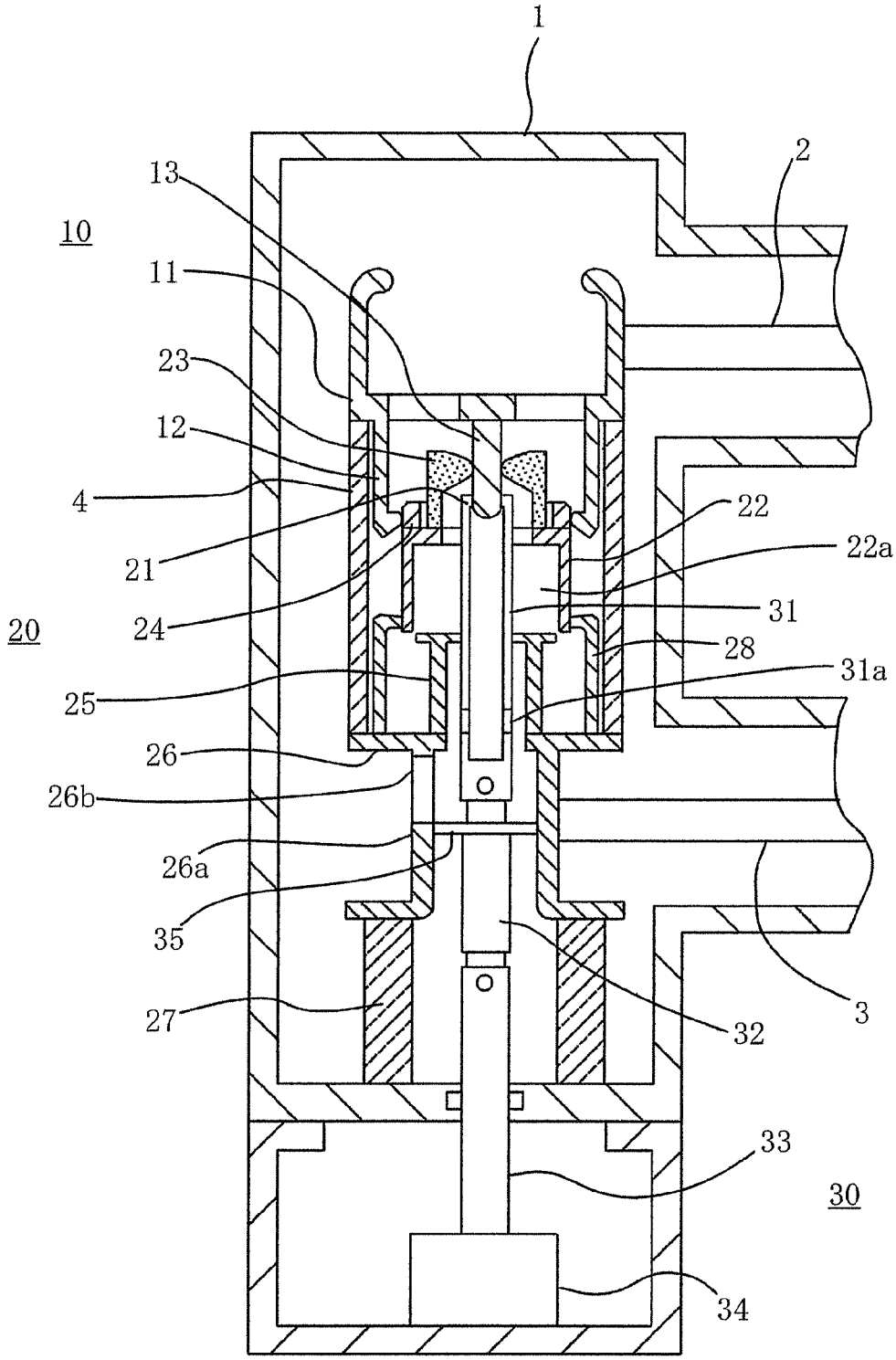
FIG. 1A is a sectional view showing a closed state of a puffer-type gas blast circuit breaker according to Embodiment 1 of the present invention.
Figure 1B:
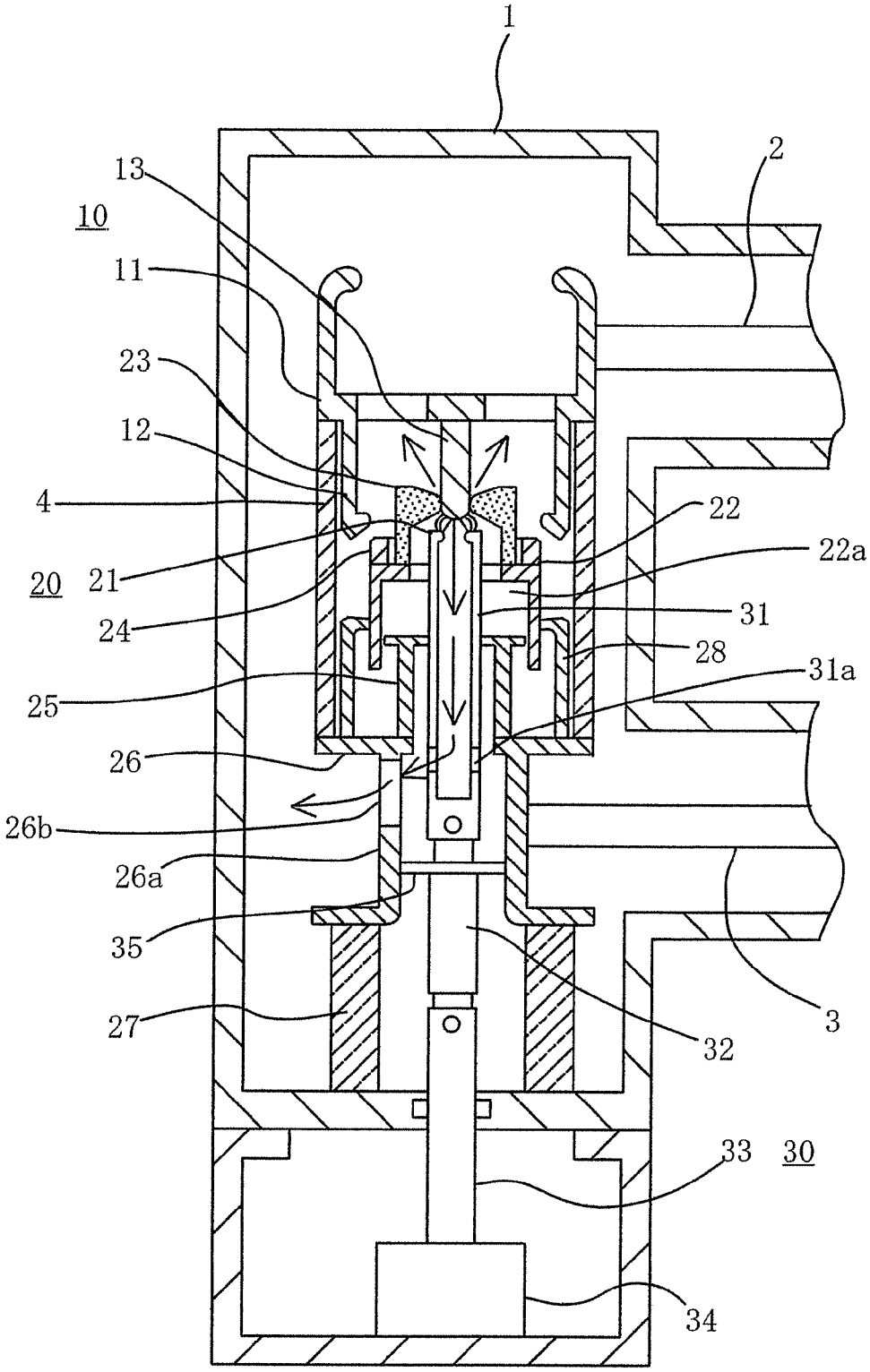
FIG. 1B is a sectional view showing a state immediately after the opening operation of the puffer-type gas blast circuit breaker according to Embodiment 1 of the invention.
Figure 1C:
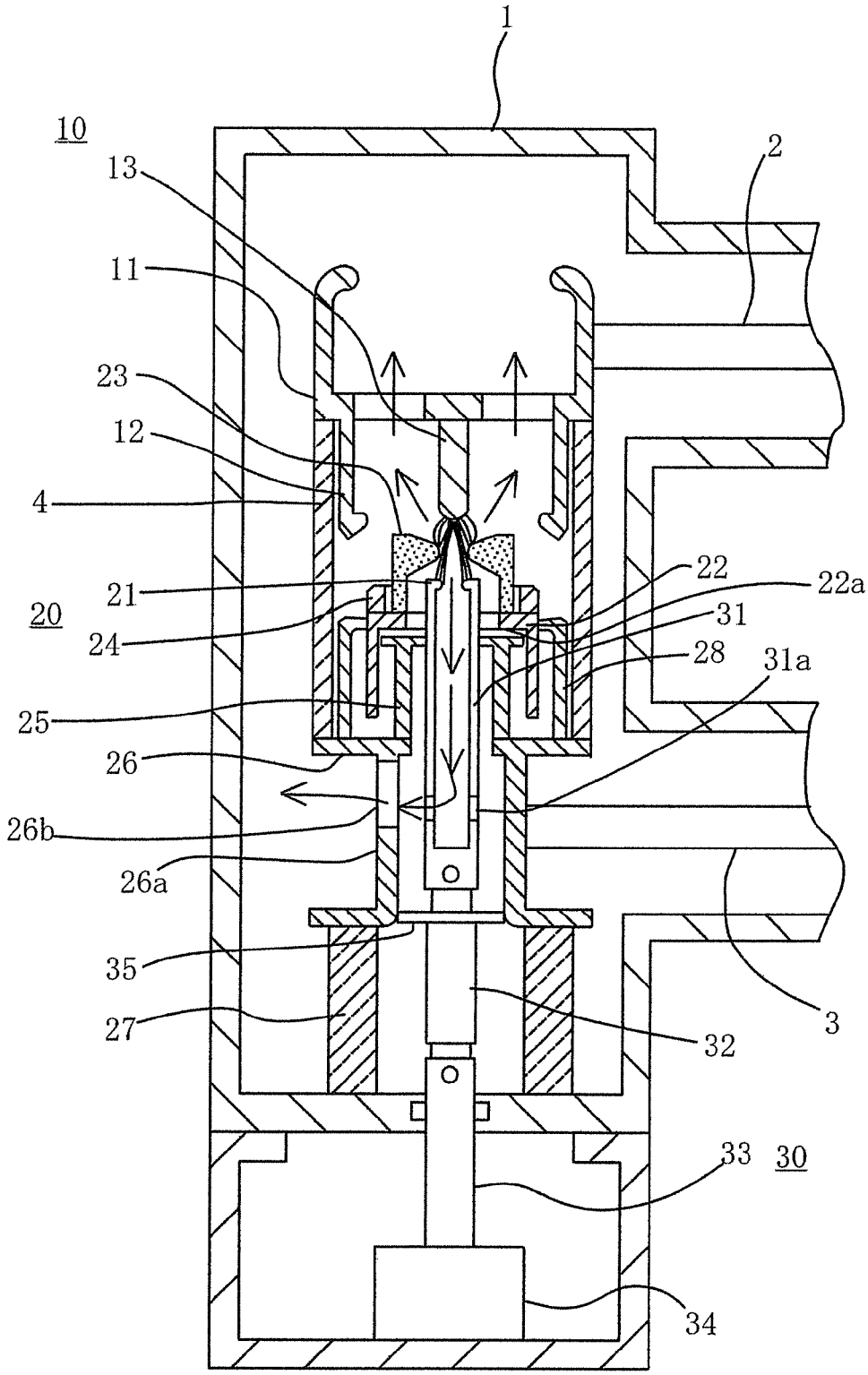
FIG. 1C is a sectional view showing a stage of completing the opening of the puffer-type gas blast circuit breaker according to Embodiment 1 of the present invention.

FIG. 1 is a sectional view showing a construction of a puffer-type gas blast circuit breaker according to Embodiment 1 of the present invention, and in which FIG. 1A is a sectional view showing a closed state of the puffer-type gas blast circuit breaker, FIG. 1B is a sectional view showing a stage intermediately after the opening process, and FIG. 1C is a sectional view showing a stage of completing the opening.

Referring to FIG. 1 showing a puffer-type gas blast circuit breaker, a stationary electrode section 10 includes a stationary side arc contact 13 disposed at the center, a stationary side main contact 12 disposed at the outer circumference, and a stationary side electrode support 11 for supporting the stationary side arc contact 13 and the stationary side main contact 12.

In the moving electrode section 20, a moving side arc contact 21 is disposed at the center and a moving side main contact 24 is disposed at the outer circumference, and these contacts are respectively mounted on a puffer cylinder 22 forming a puffer chamber 22*a* that generates a pressurized gas. An insulating nozzle 23 is mounted on the puffer cylinder 22*a* so as to surround the moving side arc contact 21. Further, a piston 25 that comes into the puffer chamber 22*a* of the puffer cylinder 22 and generates a pressurized gas is fixed to a stationary member 26 supported on an insulting support 27. The stationary member 26 is provided with a sliding contact 28 that slides and comes in contact with the outer circumference of the puffer cylinder 22. The stationary member 26 and the stationary side electrode support 11 are connected through an insulating cylinder 4.

The piston rod 31 that makes the moving electrode section 20 come in contact with and separate from the stationary electrode section 10 is formed to be hollow, and the moving side arc contact 21 is connected to a tip of one end of the piston rod 31. Furthermore, the piston rod 31 is connected to the puffer cylinder 22, the other end thereof is sealed, and a heated gas discharge port 31*a* is provided on the side of the other end.

An operation mechanism 30 comprises an insulating rod 32 connected to the piston rod 31, an operating rod 33 connected to an insulating rod 32, and an operation device 34 to which the operating rod 33 is connected. A gas flow blocking member 35 is mounted on the insulating rod 32 of the end of the piston rod side so that a heated gas discharged out of the heated gas discharge port 31*a* of the piston rod 31 is not directed to the internal part of the insulating support 27.

In addition, insulating gas such as SF6 is sealed in the closed container 1. A first conductor 2 is connected to the stationary side electrode support 11, and a second conductor 3 is connected to the stationary member 26.

The stationary member 26 includes a body portion 26*a* through which the insulating rod 32 and operating rod 33 are inserted, and is provided with a flange on both sides of the body portion 26*a*. The body portion 26*a* of the stationary member 26 is formed to be cylindrical so that a gap formed between the gas flow blocking member 35 and the body portion 26*a* is minimized within the range of allowing the smooth operation of the gas flow blocking member 35. Furthermore, the body portion 26*a* of the stationary member 26 is provided with a gas discharge port 26*b* on the moving electrode side over the mentioned operation range of the gas flow blocking member 35.

In the puffer type gas blast circuit breaker of above construction, when beginning the opening operation as shown in FIG. 1B, the stationary side main contact 12 and the moving side main contact 24 are opened and separated from each other, and then the stationary side arc contact 13 and the moving side arc contact 21 are opened and separated from each other, thereby arc being generated.

Then, the arc is blasted with an insulating gas pressurized at a puffer chamber 22*a* of the puffer cylinder 22, whereby the insulating gas is heated by the arc and jetted out of the insulating nozzle 23 to the stationary side electrode support 11. At the same time, the insulating gas jets out of the hollow part of the piston rod 31 into the stationary member 26 side. Then the heated insulating gas of the hollow part of the piston rod 31 jets into the body portion 26*a* of the stationary member 26 through the heated gas jet port 31*a* on the other side of the piston rod 31 to be cooled by being mixed with the insulating gas of normal temperature remaining in the body portion 26*a*, then is discharged from a gas discharge port 26*b* of the body portion 26*a* of the stationary member 26 into the closed container 1.

When the mentioned puffer-type gas blast circuit breaker makes the breaking operation, the moving electrode section 20 is opened and separated from the stationary electrode section 10 to come from the state shown in FIG. 1B to the state shown in FIG. 1C, thereby arc being generated between the stationary side arc contact 13 and the moving side arc contact 21. The insulating gas pressurized to be of high pressure in the puffer cylinder 22 is jetted into the closed container 1 through the insulating nozzle 23, and at the same time goes downward through the hollow part of the piston rod 31. The insulating gas getting in the piston rod 31 is discharged from the heated gas discharge port 31*a* located at the lower end of the piston rod 31 into the body portion 26*a* of the stationary member 26. The insulating gas discharged into the body portion 26*a* of the stationary member 26 is inhibited from going to the insulating support 27 by means of the gas flow blocking member 35, and is mixed with the insulating gas of normal temperature remaining in the body portion 26*a*, then is discharged into the closed container 1 from the gas discharge port 26*b* of the body portion 26*a* of the stationary member 26.

In this manner, since the flow blocking member 35 is mounted on the end portion of the piston rod side of the insulating rod 32 and furthermore the body portion 26*a* of the stationary member 26 is formed to be cylindrical so that a gap between the body portion 26*a* of the stationary member 26 and the gas flow blocking member 35 is minimized within the operation range of the gas flow blocking member 35, it becomes possible to prevent the heated insulating gas from getting into the internal part of the insulating support 27, and insulation resistance of the inner surface of the insulating support 27 and the creepage surface of the insulating rod 32 is kept from lowering, resulting in a puffer-type gas blast circuit breaker of improved insulation reliability.

Embodiment 2

In the foregoing Embodiment 1, the flow blocking member is mounted on the end portion of the piston rod of the insulating rod provided through the body portion of the stationary member, and the body portion of the stationary member is formed to be cylindrical in the operation range of the gas flow blocking member, making it possible to prevent the heated insulating gas from getting into the internal part of the insulating support at the time of breaking. On the other hand, in this Embodiment 2, a gas cooling space is further formed on the outer circumference of the body portion of the stationary member in addition to the construction according to Embodiment 1.

Figure 2:
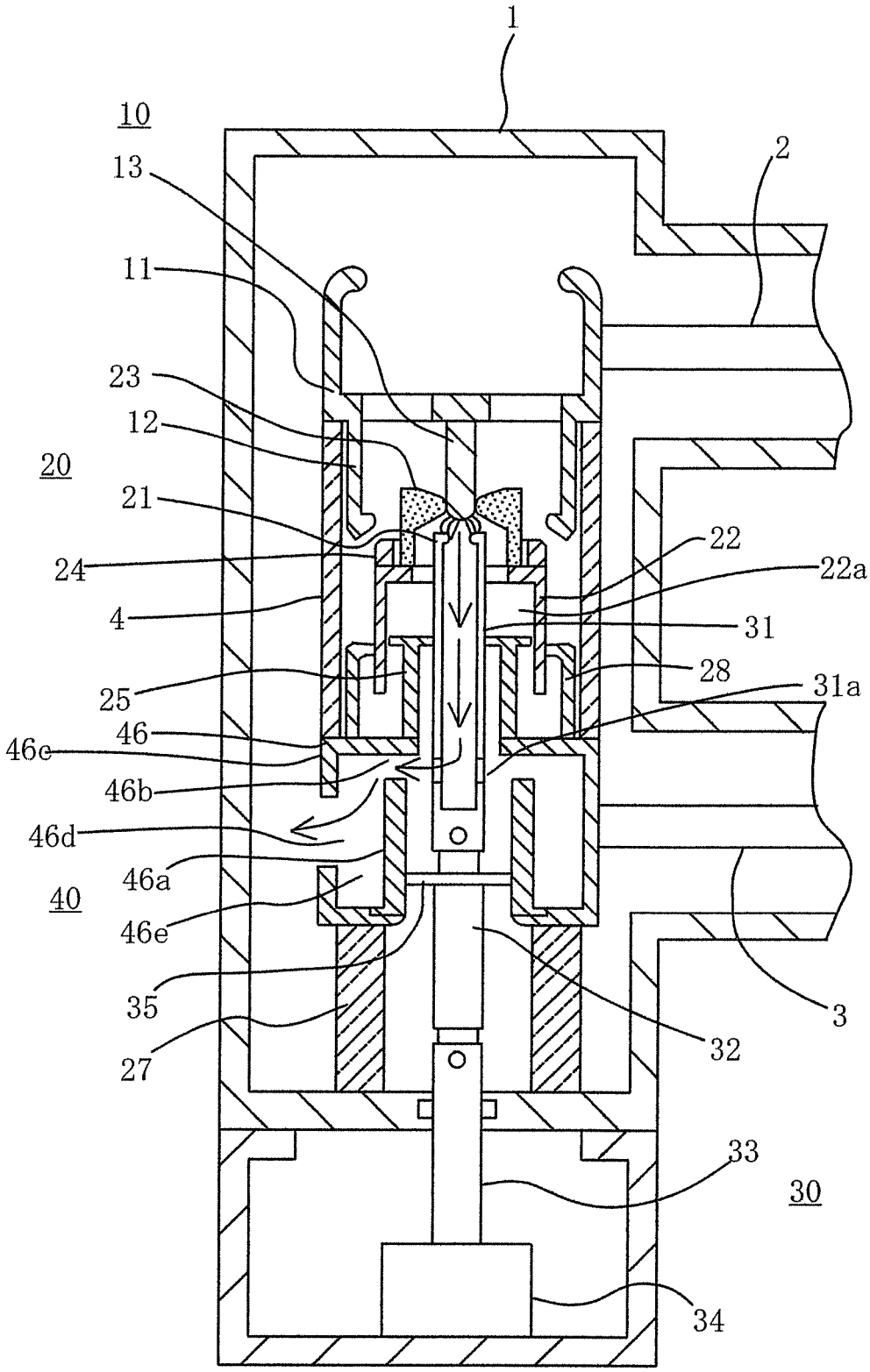
FIG. 2 is a sectional view showing a construction of the puffer-type gas blast circuit breaker according to Embodiment 2 of the invention.
Figure 3:
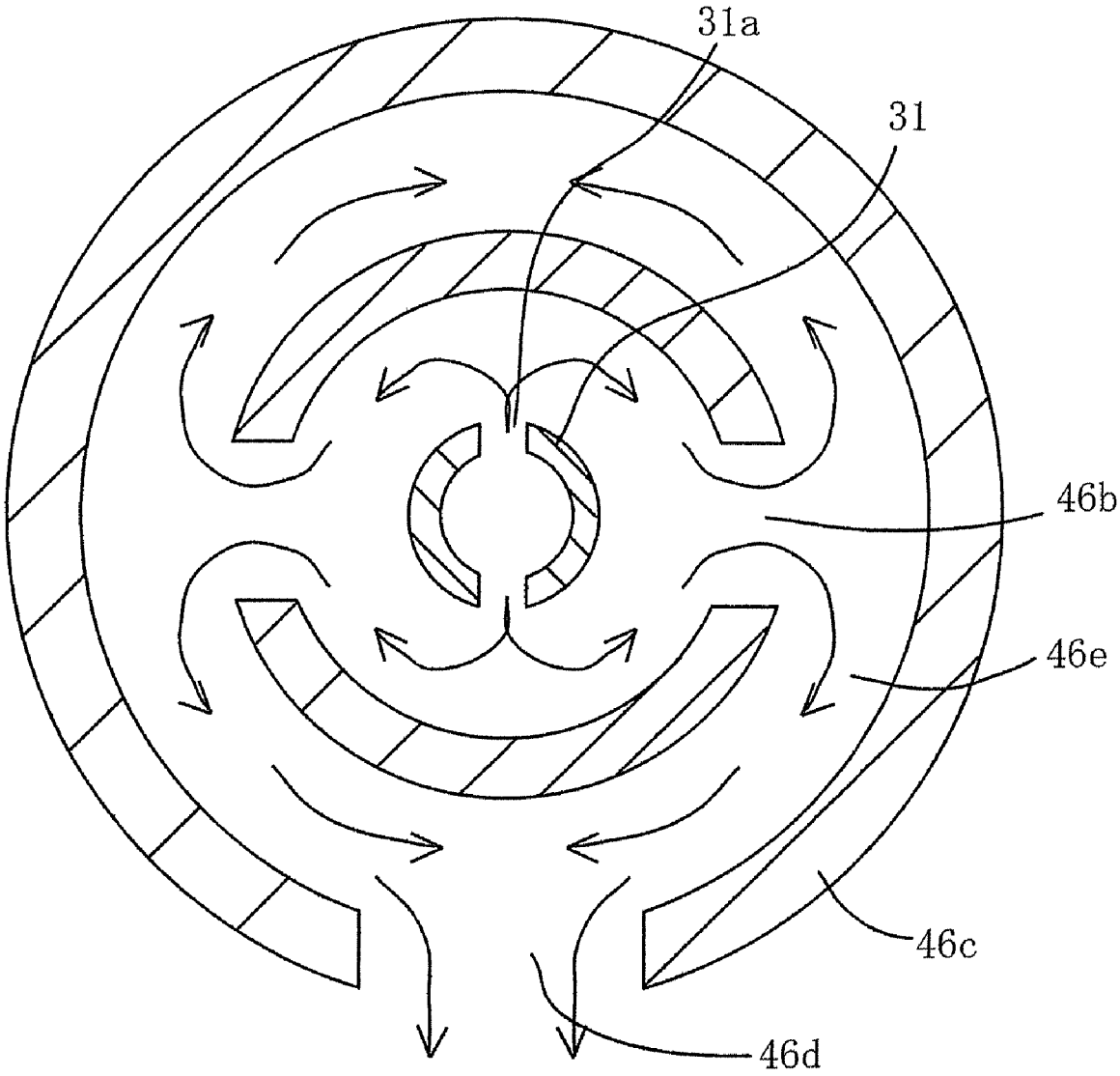
FIG. 3 is a sectional view showing a flowing state of the insulating gas in the gas cooling space of the body portion of the stationary member according to Embodiment 2 of the invention.
Figure 4A:
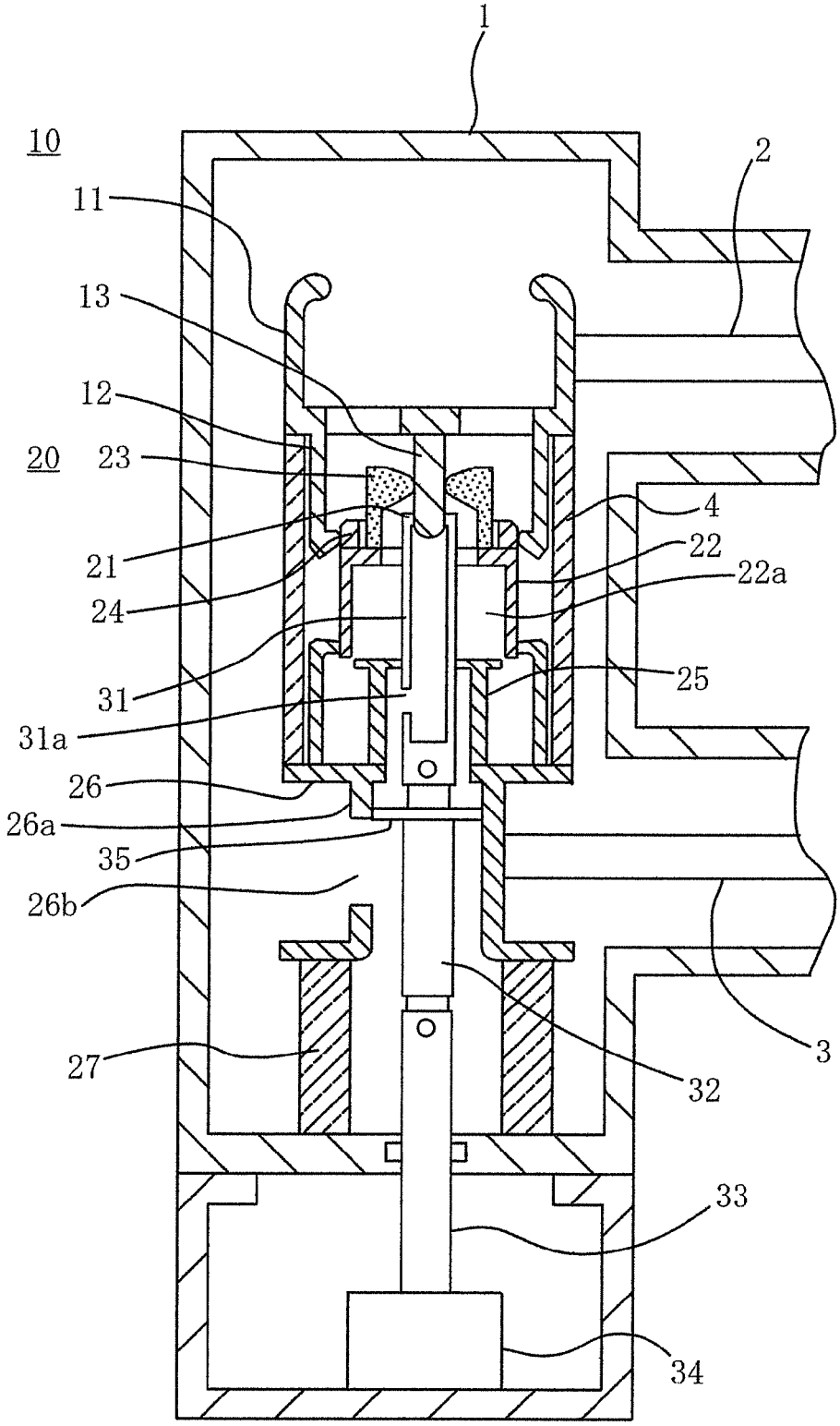
PRIOR ART Fig. 4A
FIG. 4A is a sectional view showing a closed state of the puffer-type gas blast circuit breaker according to the prior art.
Figure 4B:
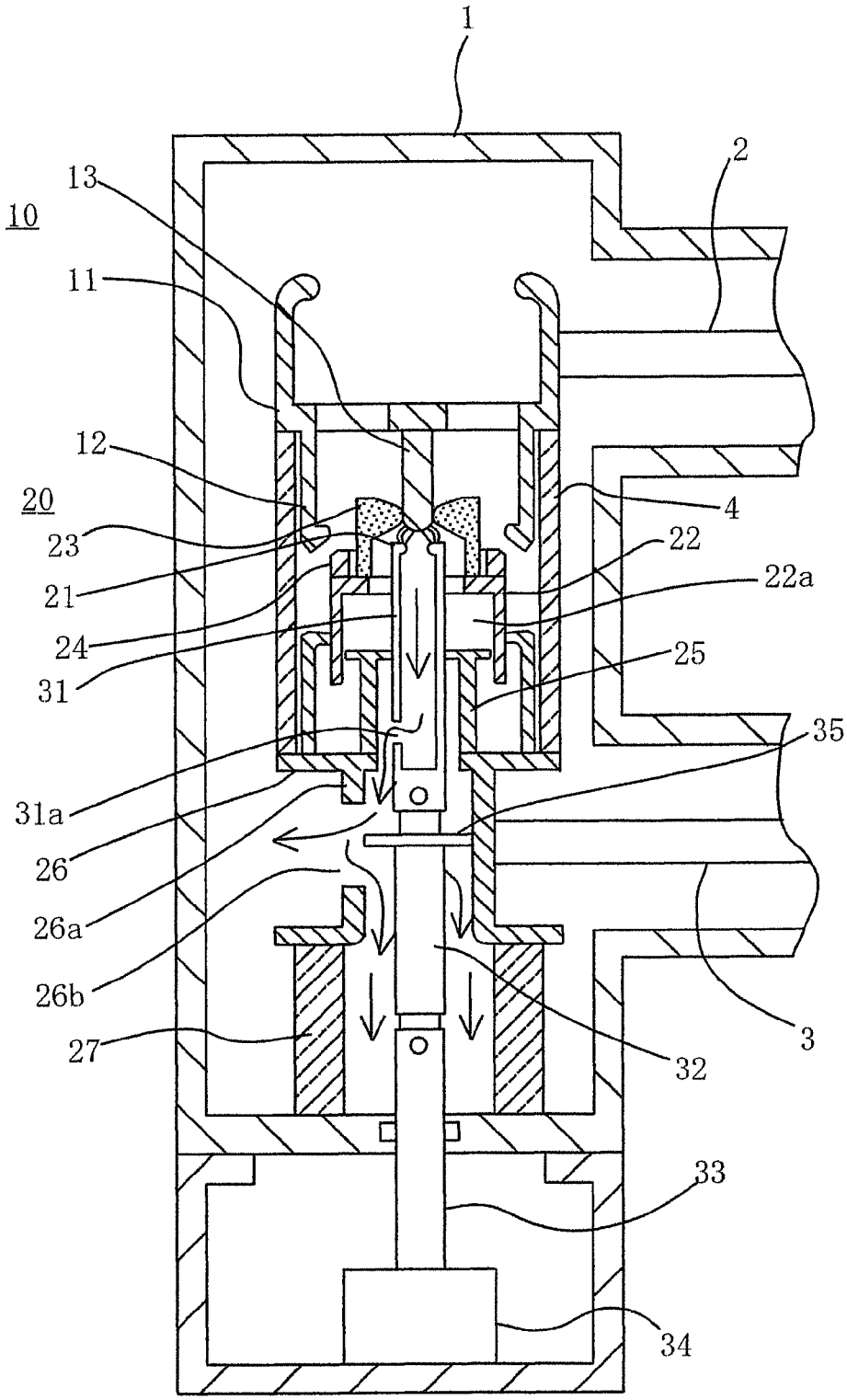
PRIOR ART Fig. 4B
FIG. 4B is a sectional view showing an intermediate stage in the opening process of the puffer-type gas blast circuit breaker according to the prior art.
Figure 4C:
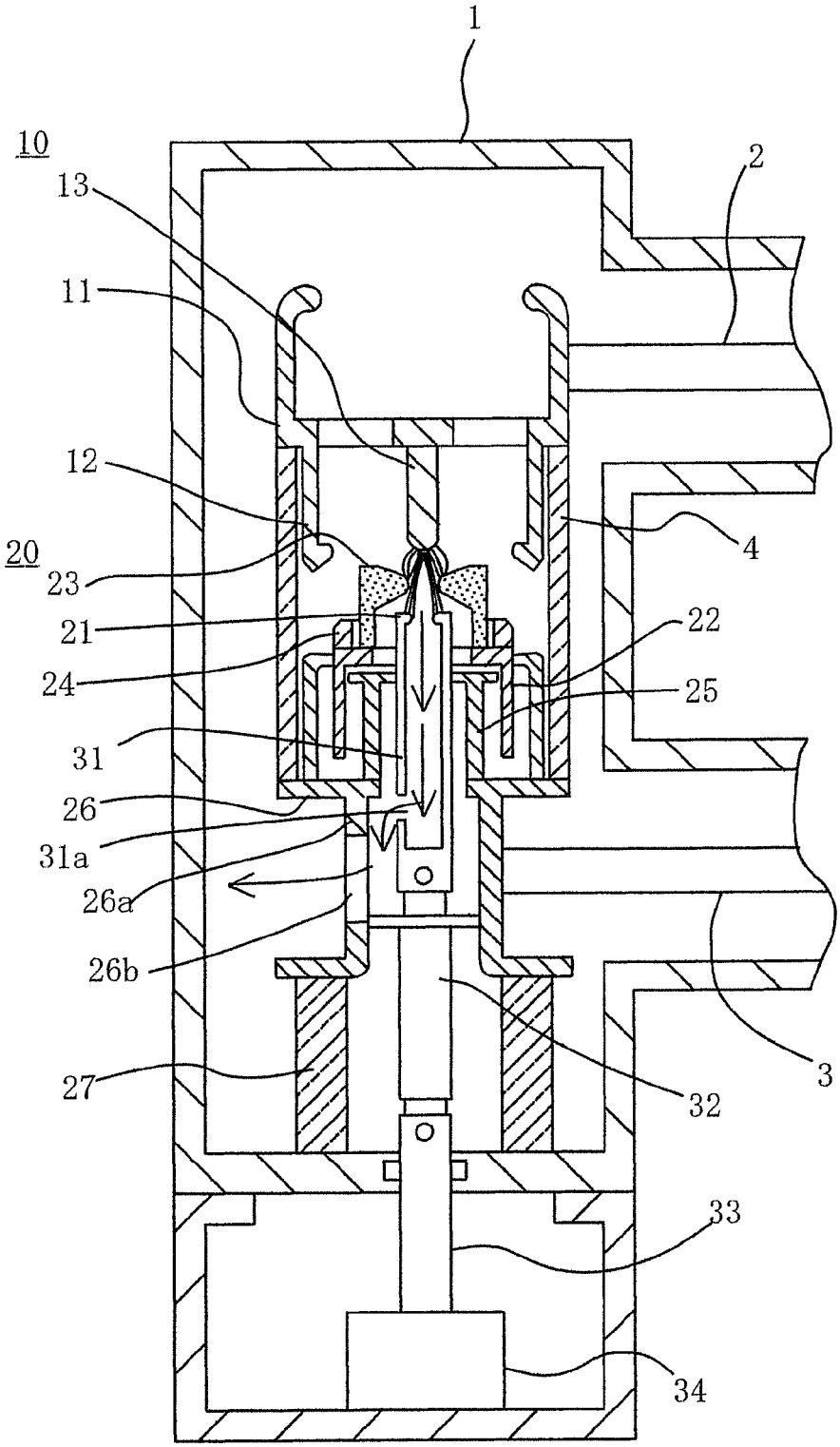
PRIOR ART Fig. 4C
FIG. 4C is a sectional view showing an opened state of the puffer-type gas blast circuit breaker according to the prior art.
Figure 5:
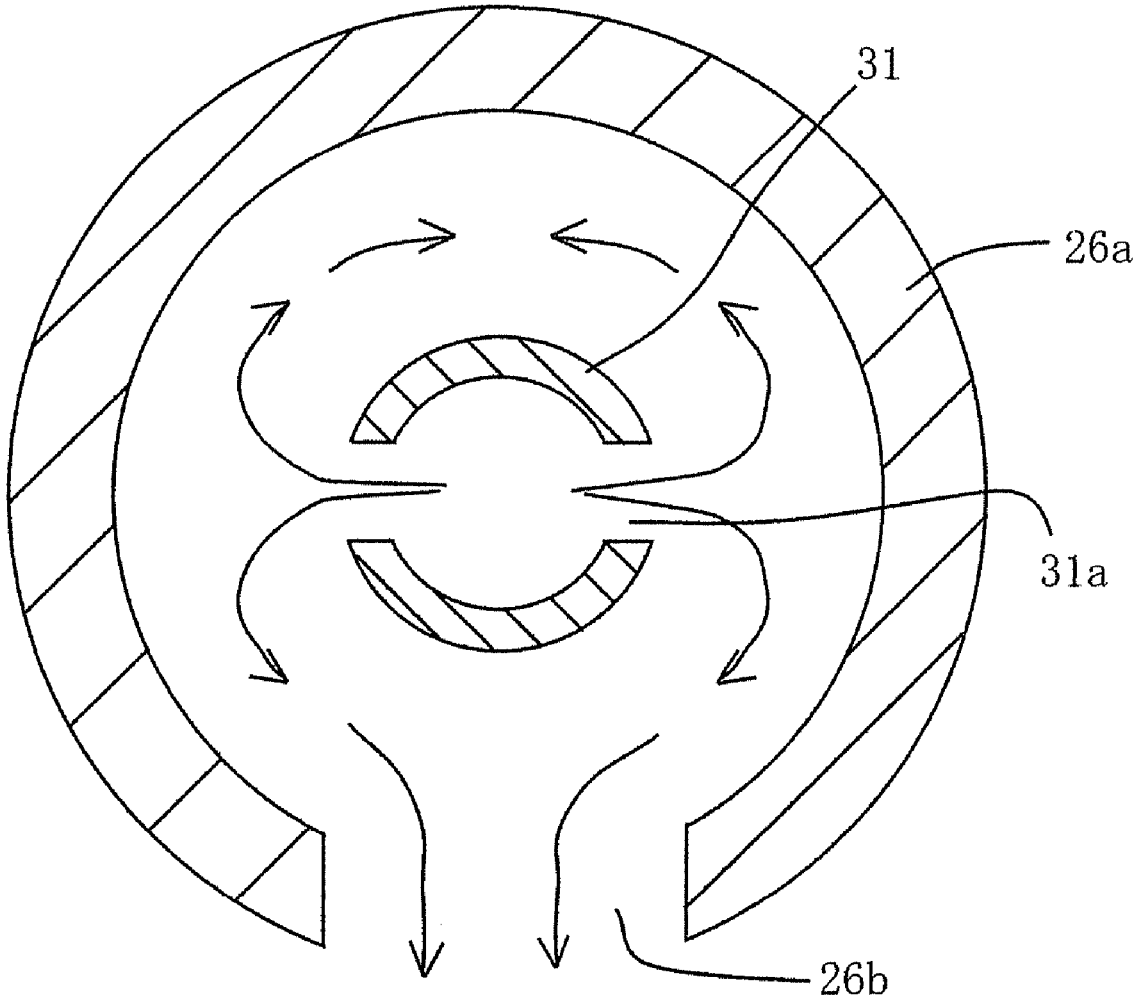
PRIOR ART Fig. 5
FIG. 5 is a sectional view showing a flowing state of the insulating gas in the gas cooling space of the puffer-type gas blast circuit breaker according to the prior art.

FIG. 2 is a sectional view showing a construction of the puffer-type gas blast circuit breaker according to Embodiment 2 of the invention, and FIG. 3 is a cross sectional view showing a portion of the gas discharge port at the body portion of the stationary member. In FIG. 2, the same reference numerals indicate the same or like parts as in the foregoing Embodiment 1, and further detailed description is omitted except the stationary member 46 referring to FIG. 2.

A difference between the stationary member 46 according to this Embodiment 2 and the stationary member 26 according to the foregoing Embodiment 1 exists in that an outer cylinder 46*c* is added to the body portion 46*a* of the stationary member 46, whereby a heated gas cooling space 46*e* is formed on the outer circumference of the body portion 46*a*. This outer cylinder 46*c* is provided with an outer cylinder opening 46*d* so that the cooled gas may be discharged perpendicularly to the moving direction of the moving electrode 20.

In the puffer type gas blast circuit breaker of above construction according to this Embodiment 2, the heated insulating gas discharged from the heated gas discharge port 31*a* of the piston rod 31 is mixed with and cooled by the insulating gas of normal temperature at the inner circumference of the body portion 46*a* of the stationary member 46. Then, the cooled gas is discharge to a gas cooling space 46*e* to be further mixed with and cooled by the insulating gas of normal temperature at the gas cooling space 46*e* and discharged into the closed container 1.

Thus, as a result of forming the gas cooling space 46*e* additionally to the construction according to the foregoing Embodiment 1, the insulating gas to be discharged into the closed container 1 is cooled and discharged more exactly than in the foregoing Embodiment 1. Accordingly, not only insulation resistance of the inner circumferential part of the insulating support is restrained from lowering but also that of the internal part of the closed container 1 is restrained from lowering. Consequently, it becomes possible to construct a puffer type gas blast circuit breaker of more improved reliability. It becomes also possible to construct a puffer type gas blast circuit breaker of which breaker size is downsized as compared with the conventional construction.

While the presently preferred embodiments of the invention have been shown and described, it is to be understood that these disclosures are for the purpose of illustration and that various changes and modifications may be made without departing from the scope of the invention as set forth in the appended claims.

What is claimed is:

1. A puffer-type gas blast circuit breaker comprising:

an electrode section in which stationary side arc contact and moving side arc contact are disposed facing each other so as to come in contact with and go separating from each other, said electrode section being mounted on a stationary member supported in an insulating manner on an insulating support;

a hollow piston rod and an insulating rod that are connected to said moving side arc contact so as to come in contact with and go separating from said stationary side arc contact, said connected hollow piston rod and insulating rod being inserted in a body portion of said stationary member; and a gas flow blocking member mounted on an end portion of said piston rod side of said insulating rod, said gas blocking member preventing an insulating gas heated by the arc generated at the time of breaking and coming to said stationary side from the hollow part of said piston rod from getting into said insulating rod side in an opening state of said circuit breaker;

wherein said body portion of the stationary member is formed to be cylindrical so that a gap between said body portion of the stationary member and said gas flow blocking member is minimized within the operation range of said gas flow blocking member, said body portion including a gas flow discharge port which is positioned on a same side as a heated gas discharge port of said piston rod with respect to said gas flow blocking member when said gas blast circuit breaker is in a closed state.

2. The puffer-type gas blast circuit breaker according to claim 1, wherein an outer cylinder is formed on the outer circumference of said body portion of said stationary member, and a gas cooling space is formed where the heated insulating gas discharged from the heated gas discharge port of said piston rod and coming in through the inner circumference side of said piston rod at the time of breaking is mixed with an insulating gas of normal temperature.

* * * * *